US012687097B2

(12) United States Patent
Marthinussen et al.

(10) Patent No.: US 12,687,097 B2
(45) Date of Patent: Jul. 21, 2026

(54) WELL STREAM COMPRESSION SYSTEM

(71) Applicant: ONESUBSEA IP UK LIMITED, London (GB)

(72) Inventors: Svein-Arne Marthinussen, Sandsli (NO); Jostein Kolbu, Lysaker (NO); Emil Gyllenhammar, Lysaker (NO); Anders Lauvdal, Gothenburg (SE)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 19/327,276

(22) Filed: Sep. 12, 2025

(65) Prior Publication Data

US 2026/0071532 A1 Mar. 12, 2026

Related U.S. Application Data

(60) Provisional application No. 63/693,977, filed on Sep. 12, 2024.

(51) Int. Cl.
*E21B 43/36* (2006.01)

(52) U.S. Cl.
CPC ..... *E21B 43/36* (2013.01)

(58) Field of Classification Search
CPC ..... E21B 43/36
See application file for complete search history.

(56) References Cited

U.S. PATENT DOCUMENTS 3,520,358 A * 7/1970 Brooks ..... E21B 43/017 166/356
2012/0103188 A1* 5/2012 Stinessen ..... F04D 25/0686 96/195

FOREIGN PATENT DOCUMENTS

GB 2215408 A * 9/1989 ..... E21B 43/40
WO WO-2015093935 A1 * 6/2015 ..... E21B 43/35
WO 2018186752 A1 10/2018

* cited by examiner

*Primary Examiner* — James G Sayre
(74) *Attorney, Agent, or Firm* — Kyle R. Miiller

(57) ABSTRACT

The present disclosure provides systems and methods for processing a well stream or production fluid, and in particular for separating and compressing the well stream or production fluid. The systems and methods include mechanisms to efficiently compress the well stream or production fluid and to mix the well stream or production fluid before it enters a compressor with one or more compressing stages, driven by a motor. A gas-to-liquid ratio of the fluid entering the compressor may be regulated to ensure it aligns with the tolerance levels and operational envelope of the compressor. In some embodiments, a cooling mechanism may be provided for the compressor motor, utilizing fluid extracted from the well stream.

17 Claims, 5 Drawing Sheets

WELL STREAM COMPRESSION SYSTEM

CROSS-REFERENCE TO RELATED APPLICATION

This application claims priority to U.S. Provisional Patent Application No. 63/693,977, filed Sep. 12, 2024.

FIELD

The present disclosure relates generally to compression systems for multiphase flows, and in particular to compression systems and methods used in subsea well stream processing for handling a multiphase production fluid flow.

BACKGROUND

Compression systems may be utilized for hydrocarbon reserves, including subsea installations, to boost a pressure of the production fluid flow that exits a well. The compression system may be sensitive to an excess of liquid in the production fluid flow. A multiphase production fluid flow may be treated or conditioned to separate gas and liquid phases upstream from the compression system. This may enable compressing dry gas or nearly dry gas via the compression system. The separated liquid can be boosted by a pump. The gas and liquid phases can either be recombined downstream from the compression system and pump and transported in one pipeline to the receiving host, or the gas and liquid phases may be transported in separate pipes.

SUMMARY

In one independent aspect, provided herein is a production system including a wellhead configured to receive a production fluid from a well and a compression system operable to facilitate extraction of the production fluid from the well. The compression system includes a compressor and a separation sub-system upstream from the compressor. The separation sub-system includes a separation unit including a pressure vessel operable to separate the production fluid, or a fluid stream derived from the production fluid, into a gas phase stream and a liquid phase stream, a first line configured to receive the gas phase stream from the separation unit, and a second line configured to receive the liquid phase stream from the separation unit. The first line is connected to a suction line of the compressor at a junction and the second line is connected to the junction such that the gas phase stream flowing through the first line mixes with the liquid phase stream flowing through the second line at the junction to form a compressible fluid stream that is directed toward the compressor via the suction line.

In some aspects, the separation sub-system includes a flow control device positioned on the first line. In some aspects, the flow control device is configured to create a pressure differential across the first line and thereby facilitate driving the liquid phase stream from the separation unit into the second line.

In some aspects, the pressure vessel includes a pressure vessel scrubber, a pressure vessel cyclone, a passive pressure vessel, or any combination thereof.

In some aspects, the separation sub-system includes a first flow control device positioned on the first line and/or a second flow control device positioned on the second line. In some aspects, at least one of the first flow control device or the second flow control device is controllable to adjust a gas-to-liquid ratio of the compressible fluid stream. In some aspects, the production system includes a controller configured to control operation of the at least one of the first flow control device or the second flow control device according to a pre-programmed routine. In some aspects, the production system includes a controller configured to control operation of the at least one of the first flow control device or the second flow control device in response to a monitored fluid operating condition within the compression system.

In some aspects, the separation sub-system includes a heat exchange unit operable to extract heat from the production fluid. In some aspects, the heat exchange unit is positioned upstream from the separation unit.

In some aspects, the production system includes a cooling sub-system configured to draw a cooling fluid from the compression system. In some aspects, the cooling sub-system includes a cooling gas separation unit configured to separate a cooling gas stream from the cooling fluid, a cooling gas line connected between the cooling gas separation unit and the compressor, the cooling gas line configured to direct the cooling gas stream from the cooling gas separation unit toward an interior of the compressor, and a cooling gas exit line configured to receive the cooling gas stream from the interior of the compressor and recycle the cooling gas stream to the separation sub-system.

In some aspects, the production system includes an anti-surge line connected to a discharge line of the compressor. In some aspects, the anti-surge line is configured to recirculate at least a portion of a compressed fluid stream exiting the compressor to a portion of the compression system upstream from the compressor.

In some aspects, a subsea well site is provided that includes the production system of any one of the above-described aspects.

In another independent aspect, provided herein is a compression system for a well stream production site, the compression system being operable to facilitate extracting a production fluid from a well. The compression system includes a compressor and a separation unit positioned upstream from the compressor. The separation unit includes a pressure vessel operable to separate the production fluid, or a fluid stream derived from the production fluid, into a gas phase stream and a liquid phase stream. The compression system also includes a first line configured to receive the gas phase stream from the separation unit, the first line connected to a suction line of the compressor at a junction, and a second line configured to receive the liquid phase stream from the separation unit, the second line connected to the junction such that the gas phase stream flowing through the first line mixes with the liquid phase stream flowing through the second line at the junction to form a compressible fluid stream that is directed toward the compressor via the suction line.

In some aspects, the compression system includes a first flow control device positioned on the first line and/or a second flow control device positioned on the second line. In some aspects, at least one of the first flow control device or the second flow control device is controllable to adjust a gas-to-liquid ratio of the compressible fluid stream. In some aspects, the compression system includes a controller configured to control the at least one of the first flow control device or the second flow control device and adjust the gas-to-liquid ratio of the compressible fluid stream at different operations of the compressor. In some aspects, the controller is configured to close the second flow control device during a start-up operation of the compressor. In some aspects, during a standard operation of the compressor, the controller is configured to maintain the second flow control device in a position that selectively allows the liquid phase stream to flow through the second line while facilitating accumulation of liquid in the separation unit. In some aspects, the compression system includes a controller configured to control the at least one of the first flow control device or the second flow control device in response to a monitored fluid operating condition within the compression system. In some aspects, the controller is configured to close or meter the second flow control device in response to a detected or predicted liquid slugging event.

In another independent aspect, provided herein is a method of operating a production system for a production fluid. The method includes: channeling the production fluid from a well toward a compression system that includes a compressor and a separation sub-system upstream from the compressor; separating, via the separation sub-system, the production fluid, or a fluid stream derived from the production fluid, into a gas phase stream and a liquid phase stream; channeling, via a first line, the gas phase stream toward a suction line of the compressor; channeling, via a second line, the liquid phase stream toward the suction line of the compressor, the gas phase stream and the liquid phase stream being mixed at or upstream from the suction line into a compressible fluid stream; and controlling flow of the gas phase stream in the first line and/or flow of the liquid phase stream in the second line toward the suction line to thereby control a gas-to-liquid ratio of the compressible fluid stream.

In some aspects, the method includes extracting heat from the production fluid before separating the gas phase stream and the liquid phase stream.

In some aspects, the method includes creating a pressure differential across the first line.

In some aspects, the method may be performed to operate the production system of any one of the above-described aspects.

The following description and the appended figures set forth certain features for purposes of illustration.

BRIEF DESCRIPTION OF DRAWINGS

So that the manner where the above recited features may be understood in detail, a more particular description, briefly summarized above, may be had by reference to example aspects, some of which are illustrated in the appended drawings.

Corresponding reference numerals used throughout the drawings indicate corresponding features, elements, and components.

DETAILED DESCRIPTION

Figure 1:
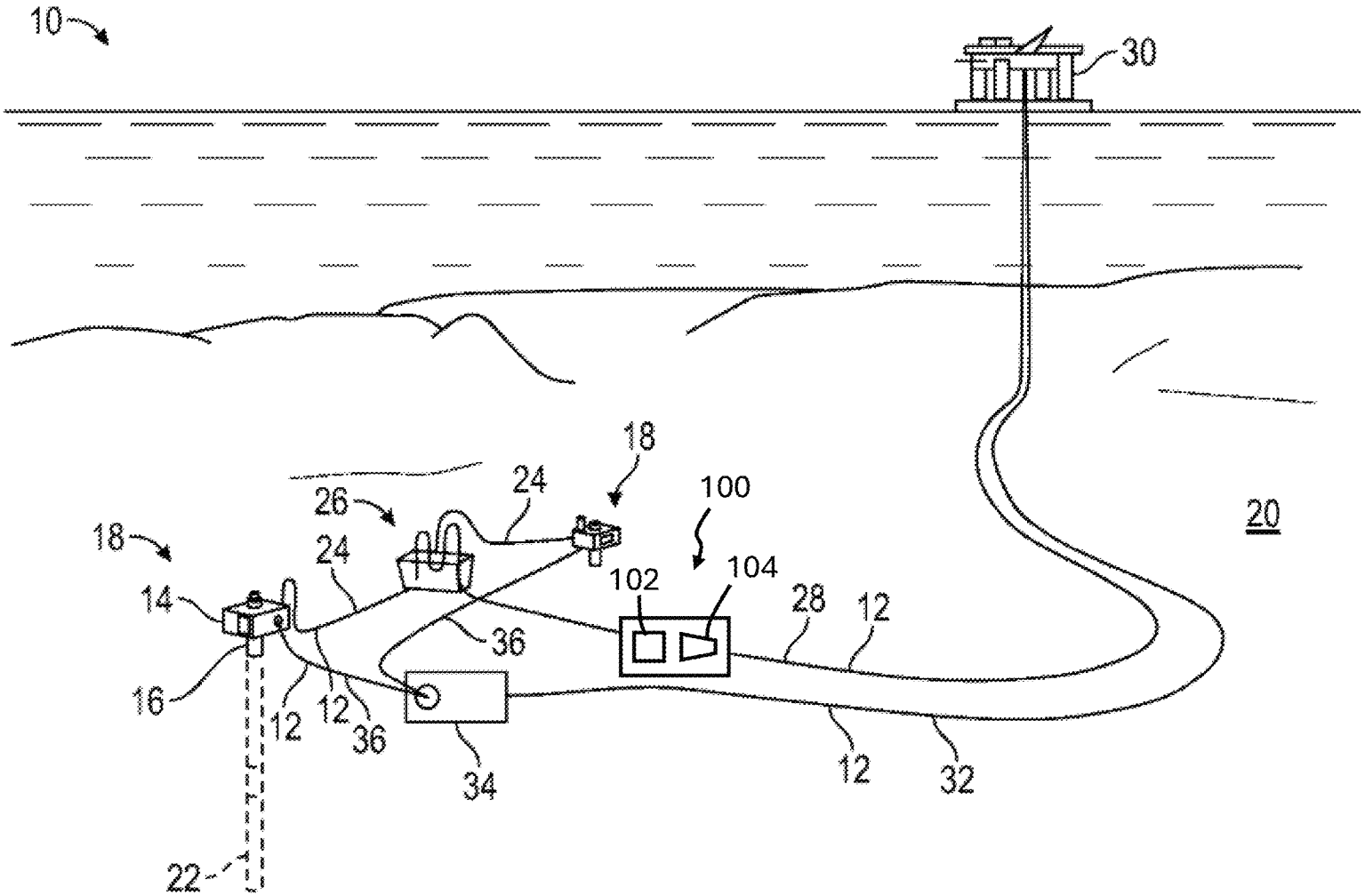
FIG. 1 is a schematic diagram of a subsea production system including one example of a compression system.

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Before any embodiments are explained in detail, it is to be understood that the embodiments are not limited to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. When introducing elements of various embodiments of the present disclosure, the articles "a," "an," and "the" are intended to mean that there are one or more of the elements. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. References to "one embodiment" or "an embodiment" of the present disclosure are not intended to be interpreted as excluding the existence of additional embodiments that also incorporate the recited features. The terms of "upstream" and "downstream" are understood relatively to the normal direction of circulation of a fluid in a conduit.

Relative terminology, such as, for example, "about," "approximately," "substantially," and the like, used in connection with a quantity or condition would be understood by those of ordinary skill to be inclusive of the stated value and has the meaning dictated by the context (for example, the term includes at least the degree of error associated with the measurement accuracy, tolerances (for example, manufacturing, assembly, use, and the like) associated with the particular value, and the like). Such terminology should also be considered as disclosing the range defined by the absolute values of the two endpoints. For example, the expression "from about 2 to about 4" also discloses the range "from 2 to 4." The relative terminology may refer to plus or minus a percentage (for example, 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

The present disclosure provides compression system and related methods for handling a multiphase production fluid without using a pump to separately handle liquids in the production fluid. The systems and methods hereof may include or utilize a compressor that can handle a certain amount of liquid in the production fluid. For example, the compressor may handle liquids that may be individual phases or combinations of condensate, water, monoethylene glycol (MEG), and any other liquids associated with conditioning of the production fluid. A separation sub-system may separate gas and liquid phases in the production fluid and selectively control a gas-to-liquid ratio in a compressible fluid stream derived from the production fluid. The gas-to-liquid ratio in the compressible fluid stream may be according to tolerance levels or an operational envelope of the compressor. In this way, the liquid levels in the production fluid are compensated for at the separation sub-system and the liquids can eventually be routed toward the compressor. Accordingly, the systems and methods hereof may obviate the need for a separate liquid pump for the liquids and associated pump equipment, including but not limited to power and controls umbilical, variable speed drive (VSD), and a hydraulic power unit (HPU). This facilitates reducing the complexity of the compression system, improving the economics and cost-effectiveness of the system, reducing the environmental footprint as fewer components are required, and reducing topside deck space requirements and associated modifications to accommodate the equipment for operation of the pump unit. In some embodiments, the systems and methods hereof may be implemented in subsea well site applications but may also be utilized in onshore, land-based, subterranean, or topside applications.

FIG. 1 is a schematic view of a well stream production system, e.g., a subsea production system 10, for extracting a production fluid from one or more wells 22. The production fluid extracted from the well(s) 22 may be a multiphase fluid mixture comprises a gas component (e.g., natural gas such as methane) and a liquid component. The liquid component may include, for example and without limitation, oil, natural gas condensate, water, and/or a conditioning fluid mixed with the production fluid such as monoethylene glycol (MEG) or methanol. The production system 10 may include electrical cables 12 used for transmitting information and power and/or heating of equipment and/or pipes. The production system 10 may also include a subsea tree 14 coupled to a wellhead 16 that may form a subsea station 18 that extracts the production fluid, such as oil and/or natural gas, from a sea floor 20 through the well 22. In some embodiments, the production system 10 may include multiple subsea stations 18 that extract production fluid from multiple, respective wells 22.

After passing through the subsea tree 14, the production fluid may flow through jumper cables 24 to a pipeline manifold 26. The pipeline manifold 26 may connect to one or more flowlines 28 to enable the production fluid to flow from the well(s) 22 to a surface platform 30. In some embodiments, the surface platform 30 may include a floating production, storage, and offloading unit (FPSO) or a shore-based facility. In addition to flowlines 28 that carry the production fluid away from the well(s) 22, the production system 10 may include lines or conduits 32 that supply fluids, e.g., conditioning fluids for the production fluid, as well as carry control and data lines to the subsea equipment. These conduits 32 may connect to a distribution module 34, which in turn may couple to the subsea stations 18 via supply lines 36.

In some scenarios, the platform 30 may be located a significant distance (e.g., greater than 100 m, greater than 1 km, greater than 10 km, or greater than 60 km) away from the well(s) 22. As the production fluid (e.g., reservoir fluids such as oil and/or natural gas) flows between the well(s) 22 and the platform 30 the fluids may cool, potentially slowing flow (e.g., due to increased viscosity) and/or allowing wax and/or hydrates to form. Conditioning fluids, such as monoethylene glycol (MEG) or methanol, may be supplied to the subsea equipment and are mixed with the production fluid to facilitate limiting preventing the formation of hydrates and/or wax. In some embodiments, heating elements, such as insulated cables (e.g., electrical cables 12), may be used to heat the flowlines 28 and facilitate preventing undesired effects of cooled production fluid.

The production system 10 also includes a compression system 100 that may be operable to drive the production fluid through the flowlines 28 toward the platform 30 and/or boost extraction of the production fluid from the well(s) 22. In some scenarios, the well(s) 22 may include marginal oil and/or natural gas reserves or relatively depleted reserves that may be at relatively low pressure. The production fluid may not naturally exit relatively low pressure well(s) 22 at a sufficient flow rate. The compression system 100 may be operable to boost the pressure and/or flow rate of the production fluid in such instances. In some embodiments, a boosted or compressed production fluid may exit the compression system 100 and may be routed onward toward the platform 30 or another desired destination for further processing.

The compression system 100 comprises a separation sub-system 102 and a compressor 104. Although a single compressor 104 is described with reference to the compression system 100, more than one compressors may be included. In embodiments where multiple compressors are included, the compressors may operate in serial or axial stages or in parallel. In some embodiments, a single compressor may include a single compression stage or multiple compression stages. The compressor 104 may include any suitable compressor for pressurizing the production fluid. For example, the compressor 104 may include a centrifugal compressor, such as an impeller-driven centrifugal compressor, a liquid ring compressor, a screw compressor, a scroll compressor, a reciprocating compressor, a diaphragm compressor, an ejector, or any combination thereof.

The compressor 104 may be configured to compress or pressurize the production fluid as a multiphase fluid comprising the gas component and some amount of the liquid component. However, relatively large amounts of the liquid component in the production fluid may negatively affect performance of the compressor 104. The liquid component is typically incompressible and relatively denser than the gas component, which can impact the ability of the compressor 104 to compress the production fluid. Moreover, the fraction of the liquid component passing through the compressor 104 may fluctuate and it is desirable to limit or prevent large "slugs" of the liquid component from being ingested by the compressor 104.

The separation sub-system 102 may be operable to control the amount of the liquid component in the production fluid supplied to the compressor 104 to maintain or optimize performance of the compressor 104 and/or limit or prevent slugging. Moreover, the separation sub-system 102 may be operable to control the phase fractions of the production fluid supplied to the compressor 104 without using a separate pump or other motive device for boosting the liquid component onward from the compression system 100. This may reduce the complexity of the compression system 100, provide a more cost-effective and efficient means of moving the production fluid through the compression system 100 and toward the platform 30 or a further processing operation, reduce the environmental footprint of the compression system 100, and/or reduce surface or topside platform space requirements and associated modifications to accommodate the equipment for operation of the separate pump unit.

Figure 2:
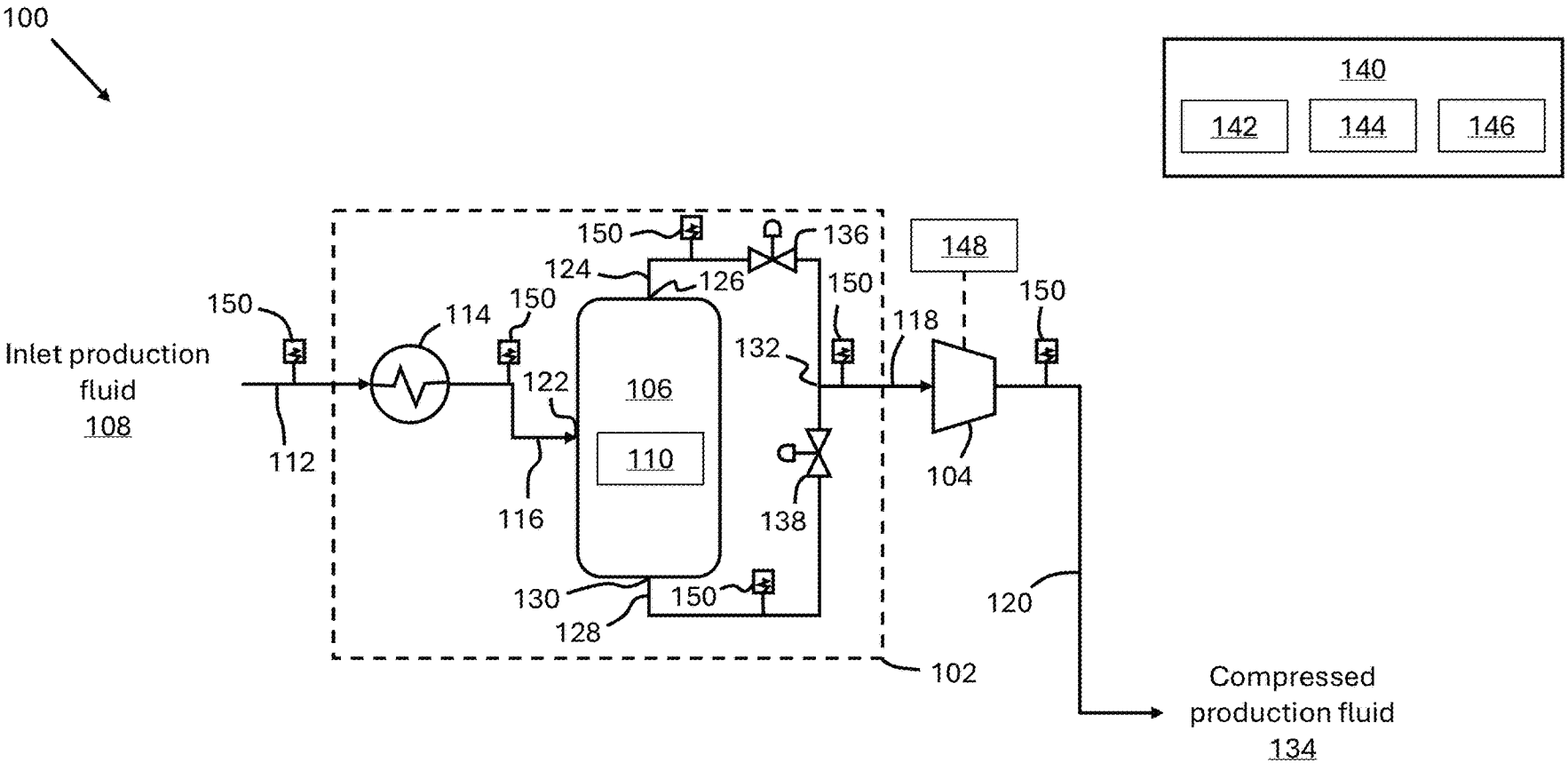
FIG. 2 is a schematic diagram of the compression system of FIG. 1.

Referring to FIG. 2, the separation sub-system 102 may include a separation unit 106 that is operable to separate a stream of the multiphase production fluid, indicated at 108, into a gas phase stream and a liquid phase stream. Although a single separation unit 106 is described with reference to the compression system 100, more than one separation unit may be included. In embodiments where multiple separation units are included, the separation units may operate in a serial arrangement or in parallel. The separation unit 106 may include any suitable configuration to facilitate phase separation of the production fluid stream 108. For example and without limitation, the separation unit 106 may include a pressure vessel. The pressure vessel in some embodiments may include a pressure vessel scrubber and/or a pressure vessel cyclone. In some embodiments, the separation unit 106 may include a passive pressure vessel that facilitates phase separation of the production fluid stream 108 over a residence time in the pressure vessel. The separation unit 106 may include a vertical separation unit or pressure vessel as shown in the illustrated example; however, a horizontal separation unit or pressure vessel may be included in some embodiments. The configuration of the separation unit 106 may vary depending on the desired quality of the gas phase stream and the liquid phase stream, and/or the tolerance levels of the compressor 104 with respect to the amount of liquid handled during compression.

The gas phase stream exiting the separation unit 106 may comprise the gas component of the production fluid stream 108, e.g., natural gas, as a primary constituent. The liquid phase stream may comprise the liquid component, e.g., oil, natural gas condensate, water, a conditioning fluid mixed with the production fluid such as monoethylene glycol (MEG) or methanol water, or any combination thereof, as a primary constituent. A "primary constituent" of a fluid stream comprises at least 50% by mass of the fluid stream. Preferably, the gas phase stream exiting the separation unit 106 comprises the gas component in an amount of at least 70% by mass. The gas phase stream exiting the separation unit 106 may comprise the liquid component as a secondary constituent. A "secondary constituent" of a fluid stream comprises less than 50% by mass of the fluid stream. Preferably, the gas phase stream exiting the separation unit comprises the liquid component in an amount of less than 30% by mass. Reference herein to a "gas phase stream" and a "liquid phase stream" denotes the primary phase of the stream but does not limit such stream to only including the described phase. The quality of the gas phase stream and the liquid phase stream exiting the separation unit 106, or the mass fraction of the desired phase in each stream, may vary according to the configuration of the separation unit 106. In some embodiments, a size or dimension of the separation unit 106 (e.g., vessel volume) and/or internal or working components driving the separation within the separation unit 106 may be adjusted to achieve a desired quality of the gas phase stream and the liquid phase stream. The configuration, e.g., size and/or internal components, of the separation unit 106 may vary depending on the requirements and tolerance levels set by the downstream compressor 104.

In some embodiments, the gas phase stream and/or the liquid phase stream may comprise solids as a secondary constituent. Solids may be extracted from production wells, e.g., the well(s) 22 of FIG. 1, and included in the production fluid stream 108 entering the compression system 100. The solids are preferably handled upstream from the compressor 104 to mitigate interference or impact the solids may have on compressor performance. The separation sub-system 102, e.g., the separation unit 106, may include a solids handler 110 that facilitates substantially uniform dispersion of solids in one or both streams and/or substantially homogenous flow of the solids in one or both fluid streams toward the compressor 104. In some embodiments, the separation sub-system 102, e.g., the separation unit 106, may include baffles, a fluidizer, an agitator or other suitable mechanism to limit or prevent accumulation or settling of solids in the separation unit 106.

The separation unit 106 may receive the production fluid stream 108 directly via an inlet line 112 of the separation sub-system 102. In some embodiments, the separation sub-system 102 may include a heat exchange unit 114, such as a condenser unit, positioned upstream from the separation unit 106 that receives and conditions the production fluid stream 108 before the production fluid is conditioned or treated via the separation unit 106. The heat exchange unit 114 may be operable to extract heat from the production fluid stream 108. Preferably, the heat exchange unit 114 may operate to lower a temperature of, or cool, the production fluid stream 108. The production fluid stream 108 may be cooled to within a suitable operating temperature range of the compressor 104 and/or to facilitate phase separation of the gas phase stream and the liquid phase stream via the separation unit 106. A cooled, multiphase fluid stream may be produced from the production fluid stream 108 via the heat exchange unit 114 and is routed toward the separation unit 106 via a cooled fluid line 116.

In some embodiments, the compression system 100 may include additional or other heat exchange units at various locations depending on the desired fluid conditions within the compression system 100 and/or the conditions of the production fluid stream 108 entering the compression system. In some embodiments, as shown in FIG. 2, the heat exchange unit 114 may be positioned upstream from the separation unit 106 and is operable to extract heat from the production fluid stream 108 entering the compression system 100 via the inlet line 112. In some embodiments, a heat exchange unit may be positioned downstream from the separation unit 106 and upstream from the compressor 104, e.g., on a suction line 118 of the compressor 104. In some embodiments, a heat exchange unit may be positioned downstream from the compressor 104, e.g., on a discharge line 120 of the compressor 104.

The heat exchange unit 114 may comprise one or more heat exchangers. In embodiments where the heat exchange unit 114 comprises multiple heat exchangers (e.g., two, three, four, five, or more than five heat exchangers), the heat exchangers may operate in series and/or in parallel. The heat exchanger(s) of the heat exchange unit 114 can comprise any heat exchanger configuration that enables the heat exchangers to transfer heat with the production fluid stream 108. For example, the heat exchanger(s) of the heat exchange unit 114 can independently comprise a coil configuration, a shell-and-tube configuration, kettle configuration and/or a plate-and-frame configuration.

The cooled, multiphase fluid stream exiting the heat exchange unit 114 may enter the separation unit 106 via an inlet 122 connected to the line 116 and is separated into the gas phase stream and the liquid phase stream as described above. In some embodiments, the heat exchange unit 114 may be bypassed or omitted and the production fluid stream 108 may enter the separation unit 106 directly via the inlet line 112. The gas phase stream may exit the separation unit 106 via an upper or overhead line 124 connected to an upper or overhead outlet 126 of the separation unit 106. The liquid phase stream may exit the separation unit 106 via a lower or bottom line 128 connected to a lower or bottom outlet 130 of the separation unit 106. The upper and lower lines 124, 128 may converge at a junction 132, which may be connected to the suction line 118 of the compressor 104. The gas phase stream and the liquid phase stream flowing through the lines 124, 128 may be mixed or combined at the junction 132 to form a compressible fluid stream or compressible fluid mixture. The junction 132 may include a static mixer or another suitable mixing device for mixing or combining the two phases into the compressible fluid stream. In some embodiments, forces within the gas phase stream and the liquid phase stream at the junction 132 may facilitate the mixing.

The compressible fluid stream may flow through the suction line 118 into the compressor 104, whereby the fluid stream is compressed to produce compressed production fluid stream 134. The compressed production fluid stream 134 may exit the compression system 100, and/or be routed onward toward the platform 30 of FIG. 1 or a further processing operation, via the discharge line 120 of the compressor 104. The compressor 104 may include a motor or drive unit 148 that mechanically operates at least one compression stage of the compressor 104. The motor 148 may be connected to at least one compression element, e.g., an impeller, via a drive shaft. A controller of the compression system 100, e.g., a controller 140 or a dedicated controller of the compressor 104, may be operable to control the speed of the motor 148 and the drive shaft to transition the compressor 104 between various compressor operations, such as start-up, ramp up, standard operation, ramp down, etc.

Flow control devices 136, 138 may be respectively positioned on the upper and lower lines 124, 128 for controlling flow of the gas phase stream and the liquid phase stream into the suction line 118. The flow control devices 136, 138 may facilitate controlling a gas-to-liquid phase ratio, also referred to as a gas-to-liquid ratio, of the compressible fluid stream that is fed to the compressor 104. A first flow control device 136 may be positioned on the upper line 124 for controlling flow of the gas phase stream and a second flow control device 138 may be positioned of the lower line 128 for controlling flow of the liquid phase stream. Although each of the upper and lower lines 124, 128 is shown with one flow control device positioned thereon, more than one flow control device may be positioned on the upper line 124 and/or lower line 128 in some embodiments.

A target gas-to-liquid ratio of the compressible fluid stream entering the compressor 104 may vary according to the tolerance levels and operational envelope of the compressor 104. In some embodiments, the gas-to-liquid mass ratio of the compressible fluid stream is preferably at least 7:3; alternatively stated, the compressible fluid stream preferably comprises the gas component in an amount of at least 70% by mass and the liquid component in an amount of less than 30% by mass.

The first flow control device 136 and/or the second flow control device 138 may be controllable via the controller 140 to regulate the gas phase and liquid phase fractions of the fluid flowing to the compressor 104 via the suction line 118. For example, the controller 140 may be operable to control the first flow control device 136 and/or the second flow control device 138 to facilitate optimizing the gas-to-liquid ratio of the compressible fluid stream in the suction line 118, maintaining the gas-to-liquid ratio of the compressible fluid stream within an operational envelope of the compressor 104, and/or limiting or preventing slugging in the compressor 104. The flow control devices 136, 138 may independently include flow control valves or other suitable flow control devices, such as metering orifices, chokes, or the like, and any combination thereof. Preferably, the second flow control device 138 is a controllable flow control device, such as a control valve, metering orifice, choke, etc., that can dynamically adjust flow of the liquid phase stream through the line 128. The first flow control device 136 may be a controllable flow control device or may be a static flow control device, such as a fixed orifice, choke, reduced diameter portion of the line 124, or the like, configured to create and/or maintain a pressure differential across the upper line 124.

The separation unit 106 may be configured to operate as an accumulator and/or buffer and may cooperate with the flow control devices 136, 138 to facilitate controlling or limiting variations in the gas and liquid phase fractions of the compressible fluid stream entering the compressor 104. In this regard, the separation unit 106 may have a volume sized to allow liquid to accumulate therein and handle transient liquid slug volumes in the production fluid stream 108. During a start- up operation of the compressor 104, the second flow control device 138 on the lower line 128 may be substantially closed to limit or restrict the liquid phase stream from entering the suction line 118 of the compressor 104 at start-up. In this way, the separation sub-system 102 may be operable to mainly or primarily supply the gas phase stream to the compressor 104 while limiting or restricting the liquid phase stream from entering the compressor 104, thereby allowing the compressor 104 to operate in a substantially gas only configuration as it reaches desired operation parameters or conditions. Once the compressor 104 has reached the desired operating parameters for standard operation, the second flow control device 138 may be opened to allow the liquid phase stream to flow towards the junction 132 and into the suction line 118 upstream from the compressor 104.

In some embodiments, the first flow control device 136 may also be configured, dimensioned, metered, or partially open, during the start-up operation to control influx of the production fluid stream 108 into the compression system 100 and facilitate controlling the ingress of liquid into the compression system 100. Liquid entering the compression system 100 may substantially accumulate within the separation unit 106 as the second flow control device 138 remains closed and the gas phase stream is fed to the compressor 104 via the lines 124 and 118. The first flow control device 136 may also create a pressure differential across the upper line 124 which may create a build up of pressure within the separation unit 106 (e.g., within the pressure vessel). The pressure within the separation unit 106 may provide a driving force to move the liquid through the lower line 128 when the second flow control device 138 is open.

As the compressor 104 ramps up, the second flow control device 138 may gradually open to allow the accumulated liquid in the separation unit 106 to exit via the lower line 128 and feed into the compressible fluid stream entering the compressor 104. The first flow control device 136 on the upper line 124 may facilitate a pressure differential across the upper line 124 that drives the liquid phase stream out of the separation unit 106 into the lower line 128 and through the second flow control device 138. In some embodiments, a pressure differential between the lower outlet 130 of the separation unit 106 and the suction line 118 may provide a driving force for the liquid phase stream through the lower line 128 toward the suction line 118. During standard operation of the compressor 104, the second flow control device 138 may be maintained or controlled at a position that allows some flow of the liquid phase stream through the lower line 128 into the suction line 118 while also enabling the accumulation of liquid in the separation unit 106, e.g., to limit or prevent slugging or to smoothen out variations in liquid within the production fluid stream 108.

The upper line 124 may have a lower resistance to flow relative to the lower line 128 and may therefore be the preferred flow path for the gas phase stream exiting the separation unit 106. The liquid phase stream exits the separation unit 106 via the lower line 128 due to gravity, pressure differential, and/or pressurization in the separation unit 106. A pressure differential may be controlled across the upper line 124 via the first flow control device 136 to allow the liquid phase stream to flow into the suction line 118 via the lower line 128 and the junction 132. The pressure differential across the upper line 124 may be controlled via a static position or configuration of the first flow control device 136. In some embodiments, the pressure differential across the upper line 124 can be adjusted, e.g., through controlling the position of the first flow control device 136, to reach a desired liquid loading in the compressible fluid stream flowing through the suction line 118 and balance the loading for the compressor 104 when desired.

The components of the compression system 100 may be positioned relative to one another to control fluid flow in the compression system 100 via differences in height or elevation. For example, the compressor 104 may be positioned vertically above a predetermined liquid level in the separation unit 106 to control the natural flow of liquid from the separation unit 106 toward the compressor 104 and/or to regulate slug volumes and the re-mixing of the different phases at the junction 132 upstream from the compressor 104 during operation. In some embodiments, the lowest point on the lower line 128 may be positioned above an outlet of the discharge line 120 of the compressor 104. The relative elevation or positioning between the lower line 128 and the discharge line 120 may allow the liquid volume to be drained from the compression system 100 where desired. In some embodiments, liquid drainage from the compression system 100 may be achieved with active or passively induced pressure differential as driving force for liquid displacement.

Operation of the compressor 104 and/or the flow control devices 136, 138 may be controlled via the controller 140. The controller 140 may include at least one processing unit or processor 142, at least one memory 144, and at least one input output (I/O) unit 146 to enable the controller 140 to function as described. The processor 142 may be, for example, a central processing unit (CPU), an application-specific integrated circuit ("ASIC"), or another suitable electronic device. The memory 144 (for example, one or more non-transitory computer-readable storage mediums), may also include data storage of any suitable type. The controller 140, via the processor 142, the memory 144, and the I/O unit 146, may communicate with components of the compression system 100 and/or external devices over one or more data connections or buses, and/or a combination thereof. Although a single controller 140 is shown in FIG. 2, the controller may also be decentralized or distributed across multiple controllers, at least some of which may be dedicated to particular components of the compression system 100. For example, the controller 140 may include a central control system that is connected to or communicates with a dedicated controller of the compressor 104. Accordingly, functionality of the controller 140 described herein may be performed using one or multiple controllers.

The controller 140 may be operable to control operation of the compression system 100 according to pre-programmed or stored routines in the memory 144. For example, the controller 140 may control operation of the compressor 104, e.g., a speed of the motor 148, during start-up, ramp up, standard operation, ramp down, and other operational stages of the compressor 104 according to pre-programmed or stored routines. Additionally, the controller 140 may control the first flow control device 136 and/or the second flow control device 138 to according to pre-programmed or stored routines at different operational stages of the compressor 104 to facilitate maintaining or optimizing the operating conditions of the compressible fluid stream in the suction line 118 according to the operational envelope of the compressor 104. The programs or routines stored in the memory 144 and executed via the controller 140 may be built according to historical performance data and/or simulations of the compression system 100 and may be periodically, continually, or continuously refined or updated over time using actual or simulated operational data of the compression system 100.

The controller 140 may be connected, or in communication with, one or more sensors 150 operable to detect operating conditions of the fluid stream(s) within the compression system 100. In some embodiments, the sensor(s) 150 may be operable to detect a pressure, temperature, flow rate, phase fractions, or another operating condition of the fluid stream(s) within the compression system 100. In some embodiments, at least one of the sensor(s) 150 includes a flow meter, such as an ultrasonic flow meter, that allows a detection of the operating flow rate and liquid mass fraction of at least one of the fluid streams in the compression system 100. Ultrasonic, acoustic, or other non-invasive sensors (e.g., non-invasive flow meters, pressure sensors, or temperature sensors clamped to an outer surface of a line or conduit) may advantageously be used to detect operating conditions of the fluid stream(s) in the compression system 100 to limit or prevent restriction to the flow path of the fluid stream, further reducing the energy expenditure related to compression process.

In the illustrated example, the sensors 150 may be positioned on the inlet line 112, the cooled fluid line 116, the upper line 124, the lower line 128, the suction line 118, and/or the discharge line 120. One or more sensors may also be positioned on or integrated with the separation unit 106 and/or the compressor 104. For example, one or more level sensors may be positioned on or integrated with the separation unit 106 to detect a level of liquid in the separation unit 106. The controller 140, e.g., via the processor 142, may be configured to receive the data or signals from the sensor(s) 150 and process the data or signals, e.g., via one or more models and/or algorithms, for dynamically controlling operation of the compression system 100 in addition to stored or pre-programmed routines. For example, the data or signals from the sensor(s) 150 may be processed via the controller to detect operating conditions (e.g., temperature, pressure, flow rate, phase fractions, etc.) within one or more lines 112, 116, 118, 120, 124, 128 of the compression system 100, or at the separation unit 106 and/or compressor 104, and determine one or more control functions to execute within the compression system 100 in response. In some embodiments, the sensor data or signals may be processed via the controller 140 with data, algorithms, or models stored in the memory 144, such as by running comparisons with stored correlations, e.g., pressure drop correlations or liquid phase fraction correlations, via a software module or system. The controller 140 may generate control signals to control operation of the compression system 100, e.g., operation of the first flow control device 136, the second flow control device 138, the compressor 104 via the motor 148, based on the processed data.

The sensor(s) 150 positioned on the lines 112, 116 upstream from the separation unit 106, or positioned on or integrated with the separation unit 106, may be used via the controller 140 to detect operating conditions of the incoming production fluid stream 108 which may be indicative of transient liquid slug volumes or other changes in the conditions of the production fluid stream 108 that may affect operation of the compressor 104. Changes in the operating conditions of the incoming production fluid stream 108 may be utilized via the controller 140 in a feedforward control loop for controlling the first flow control device 136, the second flow control device 138, and/or the compressor 104 to mitigate effects on the operation of the compressor 104. For example, the controller 140 may be operable to control the second flow control device 138 to temporarily limit flow of the liquid phase stream through the lower line 128 when a transient liquid slug volume is detected in the production fluid stream 108, thereby allowing the liquid volume to accumulate in the separation unit 106 and maintaining the gas-to-liquid ratio of the compressible fluid stream within tolerance limits of the compressor 104.

The sensor(s) 150 positioned on the upper line 124, lower line 128, and/or suction line 118 may be used to predict or detect operating conditions of the compressible fluid stream entering the compressor 104. The operating conditions of the compressible fluid stream may be utilized via the controller 140 in a feedback control loop for controlling the first flow control device 136, the second flow control device 138, and/or the compressor 104 to mitigate effects on the operation of the compressor 104. For example, the controller 140 may be operable to control the first flow control device 136 and/or the second flow control device 138 to facilitate optimizing or maintaining the gas-to-liquid ratio of the compressible fluid stream in the suction line 118 according to the tolerance levels or operational envelope of the compressor 104 and/or to facilitate limiting or preventing slugging in the compressor 104.

Figure 3:
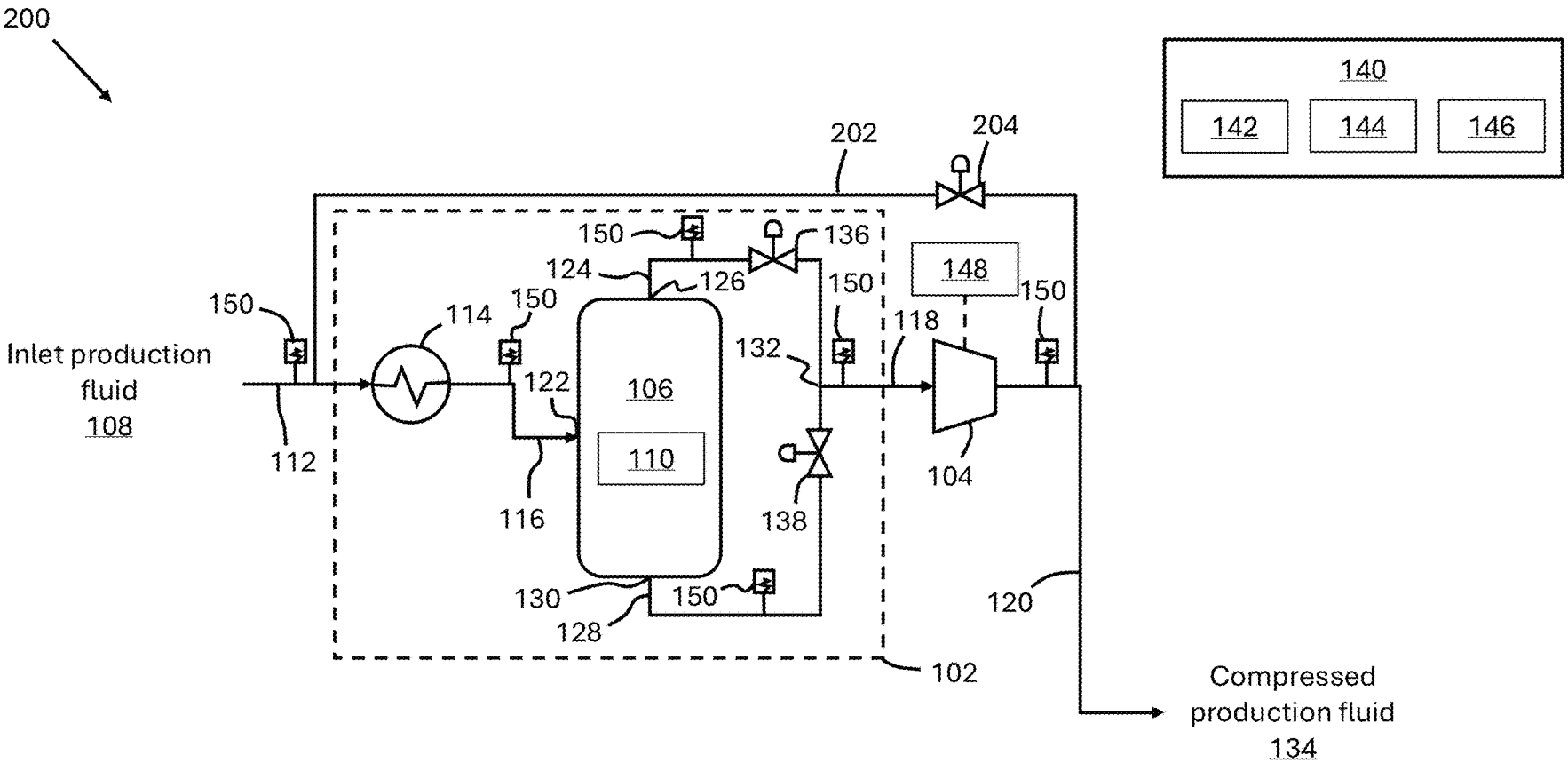
FIG. 3 is a schematic diagram of another example of a compression system that may be implemented in the production system of FIG. 1.

FIG. 3 schematically depicts another example of a compression system 200 that may be implemented in a well stream production system, such as the production system 10 of FIG. 1. The compression system 200 may include similar features as the compression system 100 of FIG. 2, with like reference numerals indicating like elements and parts. In this embodiment, the compression system 200 may also include a bypass or anti-surge line 202 that redirects or recycles discharge flow from the discharge line 120 of the compressor 104 when surge conditions are detected, e.g., via the controller 140. The anti-surge line 202 may include an anti-surge valve 204 that can be controlled to selectively open the anti-surge line 202 to allow redirection or recycling of discharge flow.

The anti-surge line 202 may feed the recycled discharge flow to a location upstream from the compressor 104, e.g., toward the inlet line 112 of the compression system 100 and/or a suction line 118 of the compressor 104. Preferably, the recycled discharge flow is cooled via a heat exchange unit, such as the heat exchange unit 114, when fed back into the compression system 100 upstream from the compressor 104. In some embodiments, a heat exchange unit may be positioned on the discharge line 120 and/or the anti-surge line 202 and may operate to cool the recycled discharge flow and allow the recycled discharge flow to be fed directly to the suction line 118.

The sensor(s) 150 positioned on the suction line 118 and/or the discharge line 120 may be utilized via the controller 140 to detect operating parameters of the compressor 104 based on the operating conditions of the compressible fluid stream in the suction line 118 and the compressed production fluid stream 134 in the discharge line 120. For example, the fluid operating conditions across the compressor 104 may signal surge conditions in the compressor 104. The controller 140 may execute one or more functions to mitigate or remediate negative operating parameters of the compressor 104. For example, the controller 140 may open the anti-surge valve 204 to allow discharge fluid from the compressor 104 to recirculate or recycle upstream from the compressor 104 via the anti-surge line 202 to relieve detected surge conditions.

Figure 4:
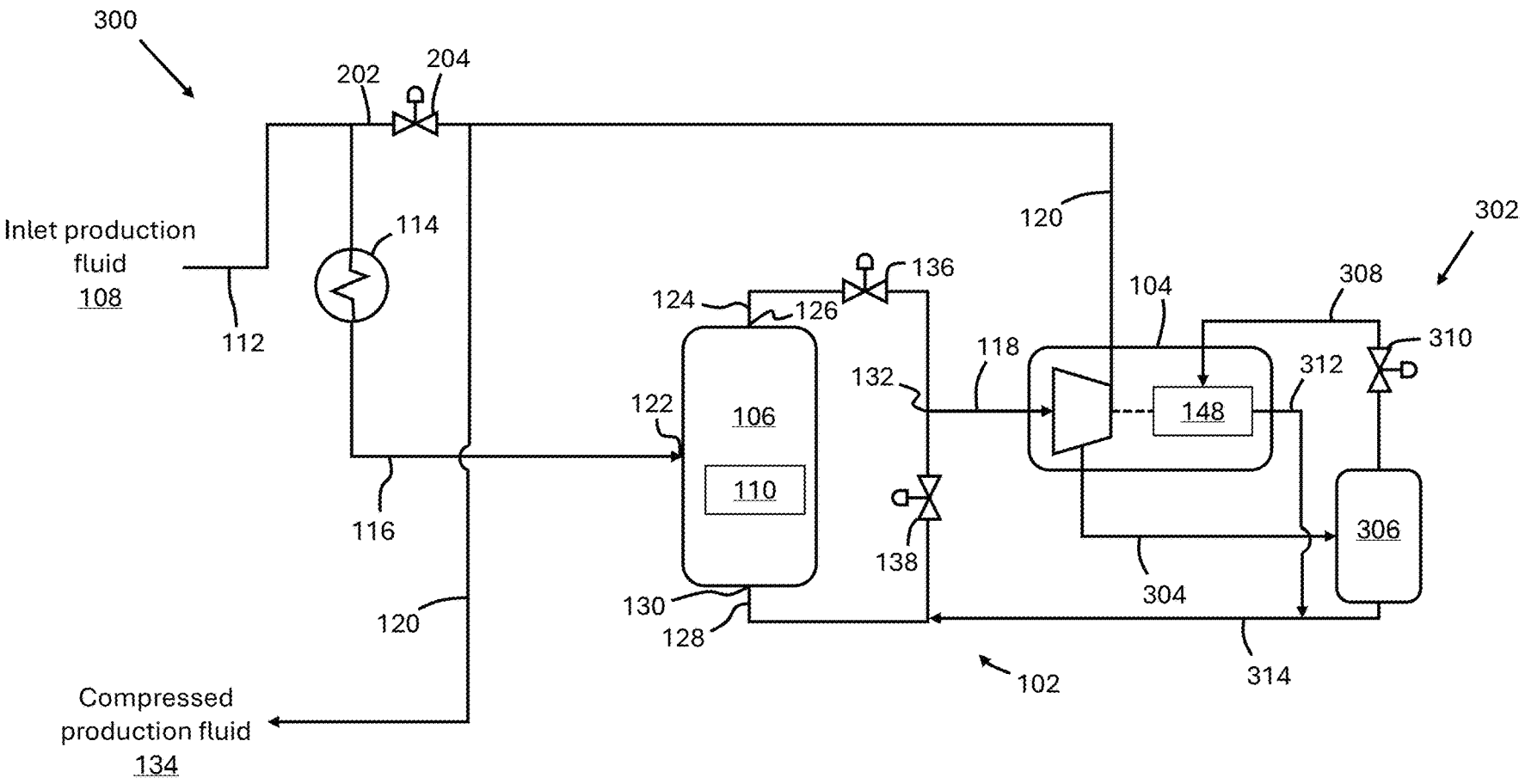
FIG. 4 is a schematic diagram of another example of a compression system that may be implemented in the production system of FIG. 1.

FIG. 4 schematically depicts another example of a compression system 300 that may be implemented in a well stream production system, such as the production system 10 of FIG. 1. The compression system 300 may include similar features as the compression system 100 of FIG. 2 and/or the compression system 200 of FIG. 3, with like reference numerals indicating like elements and parts. The features of the compression systems 100, 200, 300 may be utilized in any combination. Some features of the compression systems 100, 200 may not be depicted in FIG. 4, such as the controller 140 and the sensors 150; however this is not intended to indicate that such features are excluded from this embodiment and any of the features of the compression systems 100, 200 can be included in this embodiment. The description of the compression system 100 and the compression system 200 above is also applicable for the compression system 300 unless expressly stated otherwise or the context clearly indicates otherwise.

In this embodiment, the compression system 300 also includes a cooling sub-system 302 for cooling internal components of the compressor 104, e.g., internal components of the motor 148. The cooling sub-system 302 may draw a cooling fluid stream via a cooling line 304 connected to one or more stages of the compressor 104, e.g., one or more intermediate compression stages. The cooling fluid drawn from the compressor 104 via the line 304 may flow toward a cooling gas separation unit 306, e.g., a cooling gas scrubber, separation or pressure vessel, cyclone, etc. The cooling fluid may comprise the compressible fluid stream ingested by the compressor 104 and may be at a relatively higher pressure relative to the fluid in the suction line 118 after one or more compression stages of the compressor 104. The cooling gas separation unit 306 may be operable to separate gas and liquid phases in the cooling fluid drawn from the compressor 104.

A cooling gas stream may exit the cooling gas separation unit 306 via a cooling gas overhead line 308. The cooling gas stream may primarily comprise the gas phase of the cooling fluid drawn from the compressor 104. The cooling gas overhead line 308 may be connected to an upper or overhead outlet of the cooling gas separation unit 306. The cooling gas overhead line 308 may direct the cooling gas toward the motor 148 of the compressor 104. The cooling gas may flow through an interior of the motor 148 and facilitate cooling the internal working components of the motor 148. Optionally, the cooling gas may also flow through other interior areas of the compressor 104 to facilitate cooling in those areas as well. Optionally, a cooling gas flow control device 310, e.g., a flow control valve, metering orifice, choke, etc., may be positioned on the cooling gas overhead line 308 to control supply of the cooling gas to the internal components of the compressor 104. The cooling gas flow control device 310 may be controllable via a controller, e.g., the controller 140 of FIG. 2. In some embodiments, one or more sensor(s), e.g., temperature sensors, may be positioned to monitor internal operating conditions of the compressor 104 and the controller 140 may selectively open or close the cooling gas flow control device 310 in response to the monitored internal operating conditions of the compressor 104. For example, if the temperature of the motor 148 is above a predetermined threshold temperature value or setpoint, the controller 140 may open the cooling gas flow control device 310 to increase cooling gas flow to the motor 148.

The cooling gas may then exit the interior of the compressor 104, e.g., the interior of the motor 148, via a cooling gas exit line 312. The cooling gas exit line 312 may converge with or feed into a return line 314 that recycles or recirculates fluid back toward the separation sub-system 102. For example, the cooling gas exiting the compressor 104 may be recycled back toward the lower line 128 via the lines 312, 314. The return line 314 may also be connected to a lower or bottom outlet of the cooling gas separation unit 306 to collect a recycled liquid stream exiting the cooling gas separation unit 306. The recycled liquid stream may also be recycled back toward the lower line 128 of the separation sub-system 102 via the return line 314.

Figure 5:
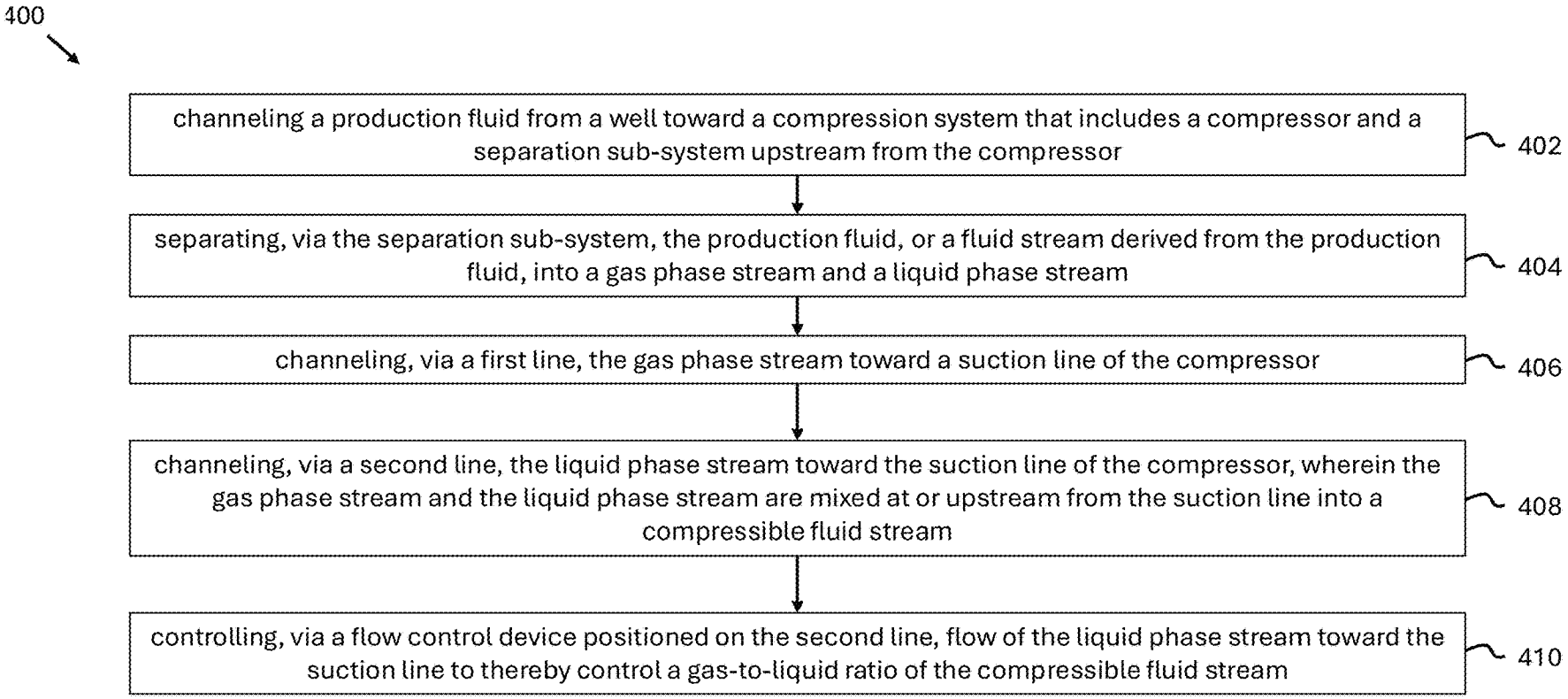
FIG. 5 is an example of a method for operating a well stream production system.

FIG. 5 is an example of a method 400 for operating a well stream production system, e.g., the production system 10 of FIG. 1. Non-limiting operations are described for the method 400. The method 400 may include additional, fewer, or different operations in other examples. Moreover, the method 400 may include operations suitable for operating a well stream production system that includes the compression system 100 of FIG. 2, the compression system 200 of FIG. 3, and/or the compression system 300 of FIG. 4. In this regard, it is understood that any of the functionality, features, or operations described above with reference to the compression systems 100, 200, 300 can be executed via the method 400. Moreover, at least some of the operations of the method may be executable via a controller, such as the controller 140 of FIG. 2.

The method 400 includes channeling 402 a production fluid from a well, e.g., a subsea well, toward a compression system, e.g., the compression system 100, 200, and/or 300. The compression system may include a compressor, e.g., the compressor 104, and a separation sub-system, e.g., the separation sub-system 102, upstream from the compressor. In some embodiments, the compressor provides at least some of the motive force for channeling 402 the production fluid from the well. The method 400 also includes separating 404, via the separation sub-system, the production fluid, or a fluid stream derived from the production fluid, into a gas phase stream and a liquid phase stream. The method 400 also includes channeling 406, via a first line such as the overhead or upper line 124, the gas phase stream toward a suction line of the compressor, such as the suction line 118. The method 400 also includes channeling 408, via a second line such as the bottom or lower line 128, the liquid phase stream toward the suction line of the compressor. The gas phase stream and the liquid phase stream may be mixed at or upstream from the suction line into a compressible fluid stream. The compressor may compress the compressible fluid stream into a compressed production fluid stream that can be routed onward for further processing. The method also includes controlling 410, via a flow control device positioned on the second line, such as the flow control device 138, flow of the liquid phase stream toward the suction line to thereby control a gas-to-liquid ratio of the compressible fluid stream. In some embodiments, the method also includes controlling, via a flow control device positioned on the first line, such as the flow control device 136, flow of the gas phase stream toward the suction line to thereby control a gas-to-liquid ratio of the compressible fluid stream. In some embodiments, the gas-to-liquid mass ratio of the compressible fluid stream is preferably at least 7:3; alternatively stated, the compressible fluid stream preferably comprises the gas component in an amount of at least 70% by mass and the liquid component in an amount of less than 30% by mass.

In some embodiments, the method 400 also includes extracting heat, e.g., via a heat exchange unit such as the unit 114, from the production fluid before separating the gas phase stream and the liquid phase stream. In some embodiments, the method 400 also includes creating, via a flow control device positioned on the first line, such as the flow control device 136, a pressure differential across the first line.

The flow control device positioned on the first line and/or the flow control device on the second line may be controlled 410 via a controller, such as the controller 140. For example, the controller may control 410 the flow control device(s) to maintain or optimize the gas-to-liquid ratio according to tolerance levels or an operational envelope of the compressor. In some embodiments, the controller may control 410 the flow control device(s) according to a pre-programmed or stored routine and based on different operations of the compressor, such as start-up, ramp up, standard operation, ramp down, etc. For example, the controller may close the flow control device on the second line during a start-up operation of the compressor and/or the controller may maintain the flow control device on the second line during a standard operation of the compressor in a position that selectively allows the liquid phase stream to flow through the second line while facilitating accumulation of liquid in the separation unit. In some embodiments, the controller may control 410 the flow control device(s) in response to fluid operating conditions within the compression system detected by one or more sensors. For example, the controller may close or meter the flow control device on the second line in response to a detected or predicted liquid slugging event.

Various processes or parts of the workflow of the present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

In embodiments, any one or any portion or all of the steps or operations of the workflow as described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general-purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

The processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

The specific embodiments described herein have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

While the present disclosure has been described with respect to a number of embodiments and examples, those skilled in the art, having benefit of this disclosure, will appreciate that other embodiments can be devised which do not depart from the scope and spirit of the present disclosure.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A production system comprising:

a wellhead configured to receive a production fluid from a well; and a compression system operable to facilitate extraction of the production fluid from the well, the compression system comprising:

a compressor; and a separation sub-system upstream from the compressor, the separation sub-system comprising:

a separation unit including a pressure vessel operable to separate the production fluid, or a fluid stream derived from the production fluid, into a gas phase stream and a liquid phase stream;

a heat exchange unit operable to extract heat from the production fluid, the heat exchange unit positioned upstream from the separation unit;

a first line configured to receive the gas phase stream from the separation unit, the first line connected to a suction line of the compressor at a junction; and a second line configured to receive the liquid phase stream from the separation unit, the second line connected to the junction such that the gas phase stream flowing through the first line mixes with the liquid phase stream flowing through the second line at the junction to form a compressible fluid stream that is directed toward the compressor via the suction line.

2. The production system of claim 1, wherein the separation sub-system further comprises a flow control device positioned on the first line, wherein the flow control device is configured to create a pressure differential across the first line and thereby facilitate driving the liquid phase stream from the separation unit into the second line.

3. The production system of claim 1, wherein the pressure vessel comprises a pressure vessel scrubber, a pressure vessel cyclone, a passive pressure vessel, or any combination thereof.

4. The production system of claim 1, wherein the separation sub-system further comprises a first flow control device positioned on the first line and a second flow control device positioned on the second line.

5. The production system of claim 4, wherein at least one of the first flow control device or the second flow control device is controllable to adjust a gas-to-liquid ratio of the compressible fluid stream.

6. The production system of claim 5, further comprising a controller configured to control operation of the at least one of the first flow control device or the second flow control device according to a pre-programmed routine.

7. The production system of claim 5, further comprising a controller configured to control operation of the at least one of the first flow control device or the second flow control device in response to a monitored fluid operating condition within the compression system.

8. The production system of claim 1, further comprising a cooling sub-system configured to draw a cooling fluid from the compression system, the cooling sub-system comprising:

a cooling gas separation unit configured to separate a cooling gas stream from the cooling fluid;

a cooling gas line connected between the cooling gas separation unit and the compressor, wherein the cooling gas line is configured to direct the cooling gas stream from the cooling gas separation unit toward an interior of the compressor; and a cooling gas exit line configured to receive the cooling gas stream from the interior of the compressor and recycle the cooling gas stream to the separation sub-system.

9. The production system of claim 1, further comprising an anti-surge line connected to a discharge line of the compressor, wherein the anti-surge line is configured to recirculate at least a portion of a compressed fluid stream exiting the compressor to a portion of the compression system upstream from the compressor.

10. A subsea well site comprising the production system of claim 1.

11. A compression system for a well stream production site, the compression system operable to facilitate extracting a production fluid from a well, the compression system comprising:

a compressor;

a separation unit positioned upstream from the compressor, the separation unit including a pressure vessel operable to separate the production fluid, or a fluid stream derived from the production fluid, into a gas phase stream and a liquid phase stream;

a first line configured to receive the gas phase stream from the separation unit, the first line connected to a suction line of the compressor at a junction;

a first flow control device positioned on the first line;

a second line configured to receive the liquid phase stream from the separation unit, the second line connected to the junction such that the gas phase stream flowing through the first line mixes with the liquid phase stream flowing through the second line at the junction to form a compressible fluid stream that is directed toward the compressor via the suction line;

a second flow control device positioned on the second line, at least one of the first flow control device or the second flow control device controllable to adjust a gas-to-liquid ratio of the compressible fluid stream; and a controller configured to:

control the at least one of the first flow control device or the second flow control device;

adjust the gas-to-liquid ratio of the compressible fluid stream at different operations of the compressor; and close the second flow control device during a start-up operation of the compressor.

12. The compression system of claim 11, wherein, during a standard operation of the compressor, the controller is configured to maintain the second flow control device in a position that selectively allows the liquid phase stream to flow through the second line while facilitating accumulation of liquid in the separation unit.

13. The compression system of claim 11, wherein the controller is controller configured to control the at least one of the first flow control device or the second flow control device in response to a monitored fluid operating condition within the compression system.

14. The compression system of claim 13, wherein the controller is configured to close or meter the second flow control device in response to a detected or predicted liquid slugging event.

15. A compression system for a well stream production site, the compression system operable to facilitate extracting a production fluid from a well, the compression system comprising:

a compressor;

a separation unit positioned upstream from the compressor, the separation unit including a pressure vessel operable to separate the production fluid, or a fluid stream derived from the production fluid, into a gas phase stream and a liquid phase stream;

a first line configured to receive the gas phase stream from the separation unit, the first line connected to a suction line of the compressor at a junction;

a first flow control device positioned on the first line;

a second line configured to receive the liquid phase stream from the separation unit, the second line connected to the junction such that the gas phase stream flowing through the first line mixes with the liquid phase stream flowing through the second line at the junction to form a compressible fluid stream that is directed toward the compressor via the suction line;

a second flow control device positioned on the second line, at least one of the first flow control device or the second flow control device controllable to adjust a gas-to-liquid ratio of the compressible fluid stream; and a controller configured to:

control the at least one of the first flow control device or the second flow control device;

adjust the gas-to-liquid ratio of the compressible fluid stream at different operations of the compressor; and during a standard operation of the compressor, maintain the second flow control device in a position that selectively allows the liquid phase stream to flow through the second line while facilitating accumulation of liquid in the separation unit.

16. The compression system of claim 15, wherein the controller is controller configured to control the at least one of the first flow control device or the second flow control device in response to a monitored fluid operating condition within the compression system.

17. The compression system of claim 15, wherein the controller is configured to close or meter the second flow control device in response to a detected or predicted liquid slugging event.

* * * * *